US006644992B2

(12) United States Patent
Maegawa

(10) Patent No.: US 6,644,992 B2
(45) Date of Patent: Nov. 11, 2003

(54) LEVER-TYPE CONNECTOR

(75) Inventor: Takao Maegawa, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 10/157,387

(22) Filed: May 28, 2002

(65) Prior Publication Data

US 2002/0182908 A1 Dec. 5, 2002

(30) Foreign Application Priority Data

May 29, 2001 (JP) ..... 2001-160797

(51) Int. Cl.[7] ..... H01R 13/62
(52) U.S. Cl. ..... 439/157; 439/347
(58) Field of Search ..... 439/157, 160, 439/347, 159

(56) References Cited

U.S. PATENT DOCUMENTS 4,981,440 A * 1/1991 Werner et al. ..... 437/347
5,269,696 A * 12/1993 Okada et al. ..... 439/157
5,888,080 A * 3/1999 Maejima ..... 439/157
6,095,833 A 8/2000 Osawa ..... 439/157

FOREIGN PATENT DOCUMENTS

JP 9-245886 9/1997

* cited by examiner

*Primary Examiner*—P. Austin Bradley
*Assistant Examiner*—Briggitte R. Hammond
(74) *Attorney, Agent, or Firm*—Gerald E. Hespos; Anthony J. Casella

(57) ABSTRACT

A connector includes a first housing (10) with a receptacle (11) and a moving plate (30) is mounted in the receptacle (11) for movement along a moving direction (MD). Escape grooves (14) are formed in the receptacle (11) and ribs (15A, 15B) extend along the escape grooves (14). A surrounding wall (32) of the moving plate (30) has notches (35) with bent portions (36A, 36B) that extend along the ribs (15A, 15B). The strength of the receptacle (11) is secured since the ribs (15A, 15B) are formed at least partly substantially along or near the escape grooves (14) of the receptacle (11), whereas the strength of the surrounding wall (32) is secured since the bent portions (36A, 36B) extend along the notches (35) on the surrounding wall (32) of the moving plate (30).

9 Claims, 11 Drawing Sheets

LEVER-TYPE CONNECTOR

BACKGROUND OF THE INVENTION

1. Field of the Invention

The invention relates to a lever-type connector.

2. Description of the Related Art

A lever-type connector with a moving plate is disclosed in U.S. Pat. No. 6,095,833 and is shown in FIGS. 9 to 11 herein. The connector includes a male housing 101 that has a receptacle 102. A lever 103 is supported pivotally on the outer surface of the male housing 101, and a moving plate 104 is provided in the receptacle 102 for positioning male terminal fittings. A female housing 105 is fittable into the receptacle 102. Cam pins 106 of the female housing 105 and cam pins 108 on a surrounding wall 107 of the moving plate 104 engage cam grooves 109 of the lever 103 when the female housing 105 is fit lightly in the receptacle 102. The female housing 105 and the moving plate 104 are connected with the male connector housing 101 by pivoting the lever 103.

The cam pin 106 of the female connector housing 105 and the cam pin 108 of the moving plate 104 are united into one cam follower for engagement with the corresponding cam groove 109. Thus, notches 111 are formed in the surrounding wall 107 of the moving plate 104 for permitting the passage of the cam pins 106 of the female housing 105. The surrounding wall 107 of the moving plate 104 is split partly in two by the notches 111, and hence strength may be reduced. Further, the receptacle 102 is formed with escape grooves 112 for permitting the passage of the cam followers 110. The receptacle 102 also is split partly into two by the escape grooves 112, and hence may have a reduced strength.

The present invention was developed in view of the above problem and an object thereof is to prevent a reduction in the strength of a receptacle of a connector housing and, preferably, also a moving plate.

SUMMARY OF THE INVENTION

The invention is direct to a lever-type connector that comprises first and second housings. The first housing includes a receptacle and a moving plate for positioning first terminal fittings in the receptacle. A lever is supported pivotally on the first housing and includes at least one cam groove. The second housing is fittable into the receptacle. At least one cam pin means is provided on the second housing and/or the moving plate. The cam pin means is adapted to pass into an escape groove of the receptacle for engagement with the cam groove in the lever. At least one rib is formed on the receptacle along or near the escape groove and extends substantially parallel with a moving direction of the moving plate. At least one bent portion is formed on the moving plate for receiving the rib. The rib ensures that the strength of the first housing is not jeopardized by the escape groove.

The rib is formed on the inner surface of the receptacle and the bent portion has a cross section bent to recess inwardly. The cross section is taken in a plane intersecting the moving direction at substantially right angles. The inwardly bent cross section of the bent portion preferably has U-shape so that a recess is formed for receiving and accommodating the rib. If a rib with a rectangular cross section is chosen, then the accommodating portion formed by the recess of the bent portion also has a rectangular cross section.

The bent portion preferably is formed on a surrounding wall of the moving plate that projects in the moving direction from the moving plate.

The cam pin means preferably comprise at least one cam pin on the moving plate for uniting with at least one cam pin on the second housing to form a cam follower that can engage the cam groove of the lever. The second housing and the moving plate preferably move as a single unit toward the first connector housing in response to pivoting the lever so that the first terminal fittings are connected with respective terminal fittings of the second housing.

The moving plate preferably has at least one notch for receiving the cam pin means and the bent portion is formed at least partly along or near the notch. The bent portion ensures that the notch does not weaken the moving plate. The notch preferably is formed on a surrounding wall of the moving plate and extends substantially in the moving direction.

A plurality of ribs and a plurality of bent portions may be formed and at least one ribs has a cross section differing from cross sections of the other ribs. The bent portions comprise accommodating portions for at least partly receiving the ribs therein, and at least one accommodating portion has a cross section differing from cross sections of the other accommodating portions. The cross sections of the accommodating portions correspond substantially to the cross sections of the respective ribs for at least partly receiving and accommodating the respective ribs therein. However, the cross sections prevent a reversed orientation of the ribs and the accommodating portions.

At least one of the thickness of the ribs and the projecting distance of the ribs from the inner surface of the receptacle is set to differ among the plurality of ribs. Similarly, the width and depth of the accommodating portions are set individually for the respective accommodating portions to correspond to the thickness and projecting distance of the ribs to be accommodated therein.

Thus, the moving plate can be mounted in the receptacle when oriented so that the ribs are accommodated in the specified accommodating portions. On the other hand, some of the ribs interfere with the bent portions and cannot be accommodated if the moving plate is oriented improperly. Thus, the moving plate cannot be mounted into the receptacle. In this way, the ribs and the bent portions prevent the moving plate from being mounted in the receptacle with an improper orientation.

Preferably, the first housing is a male housing, the first terminal fittings are male terminal fittings and the second housing is a female housing.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

A first embodiment of a lever-type connector is illustrated in FIGS. 1–7 and includes a first housing 10, a lever 20, a moving plate 30 and a second housing 40. In this embodiment, the first housing 10 is a male housing 10 and the second housing is female housing 40.

Figure 2:
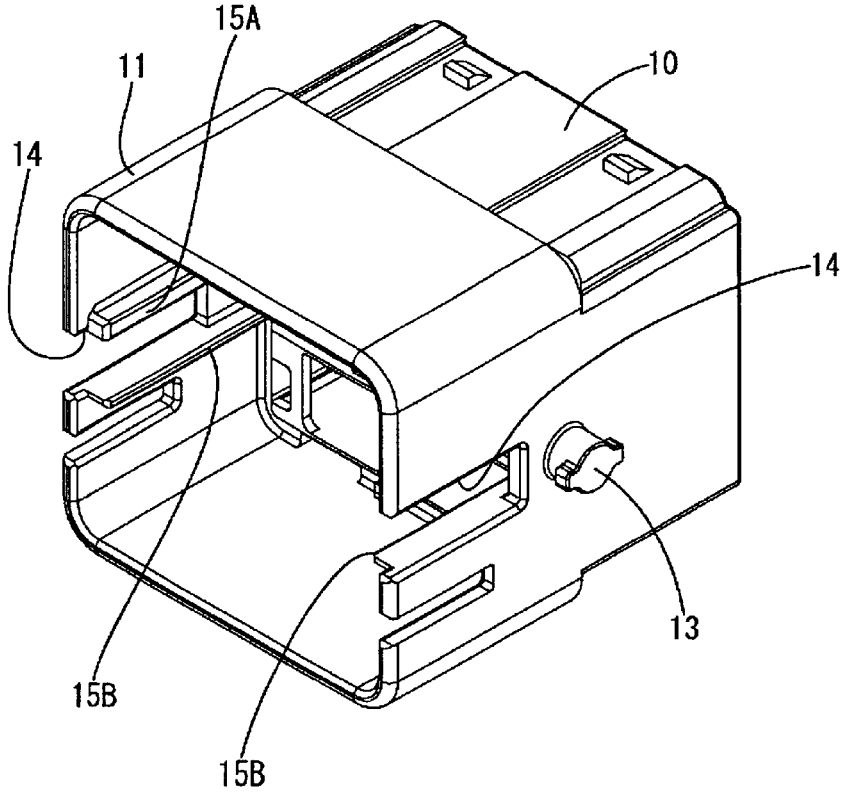
FIG. 2 is a perspective view of the male housing.

The male housing 10 includes a rectangular tubular receptacle 11 that projects forward, as shown in FIG. 2, and male tabs 12 are accommodated in the receptacle 11. Shafts 13 project from the left and right outer surfaces of the male housing 10, and the receptacle 11 has left and right escape grooves 14 that extend linearly in forward and backward directions from the front edge of the receptacle 11 toward the corresponding shafts 13. The escape grooves 14 extend substantially parallel with a connecting or moving direction MD of the housings 10, 40 and corresponds substantially to the direction in which the male tabs 12 project from the male housing 10.

Figure 4:
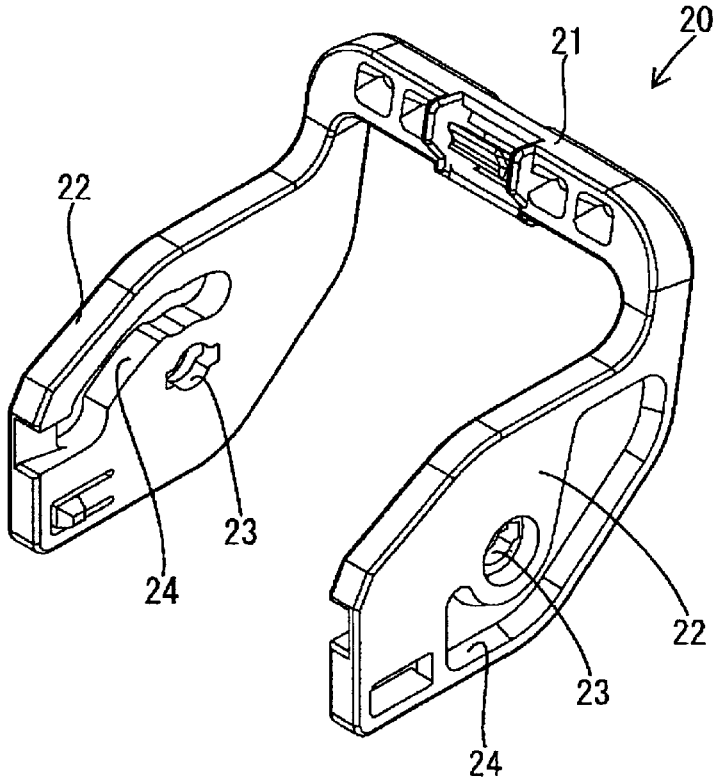
FIG. 4 is a perspective view of a lever.
Figure 5:
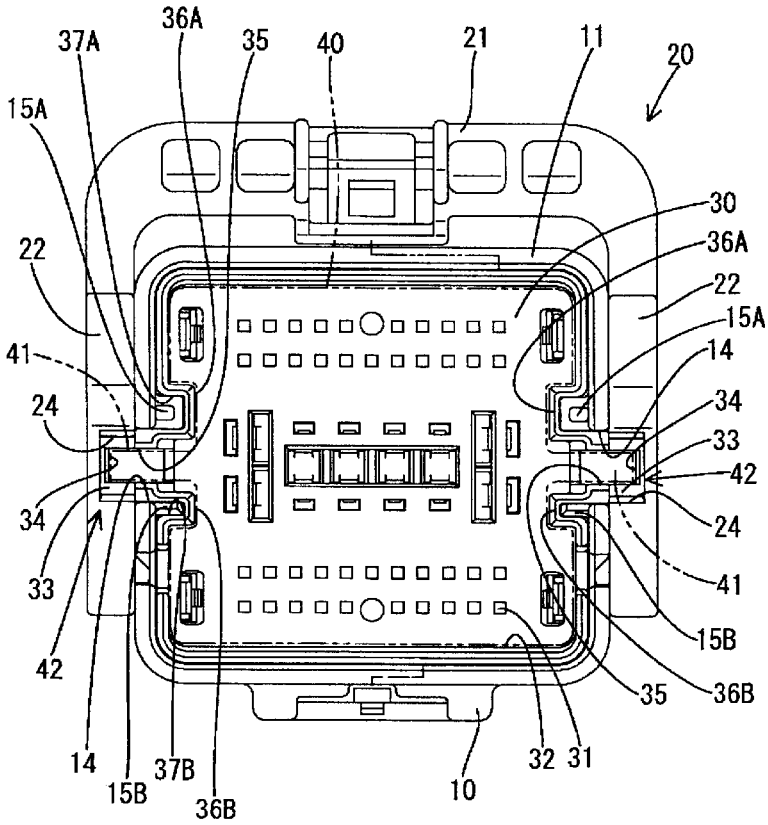
FIG. 5 is a front view showing a state where the moving plate and the lever are assembled into the male housing.

The lever 20 comprises an operable portion 21 and two plate-shaped arms 22 that extend from the opposite ends of the operable portion 21, as shown in FIG. 4. The arms 22 have engaging holes 23 mounted on the shafts 13 so that the lever 20 is pivotal between a standby position and a connection position. Cam grooves 24 are formed in the inner surfaces of the arms 22, and the entrances of the cam grooves 24 open forward when the lever 20 is at the standby position shown in FIG. 1 to permit the insertion of the cam followers 42.

Figure 3:
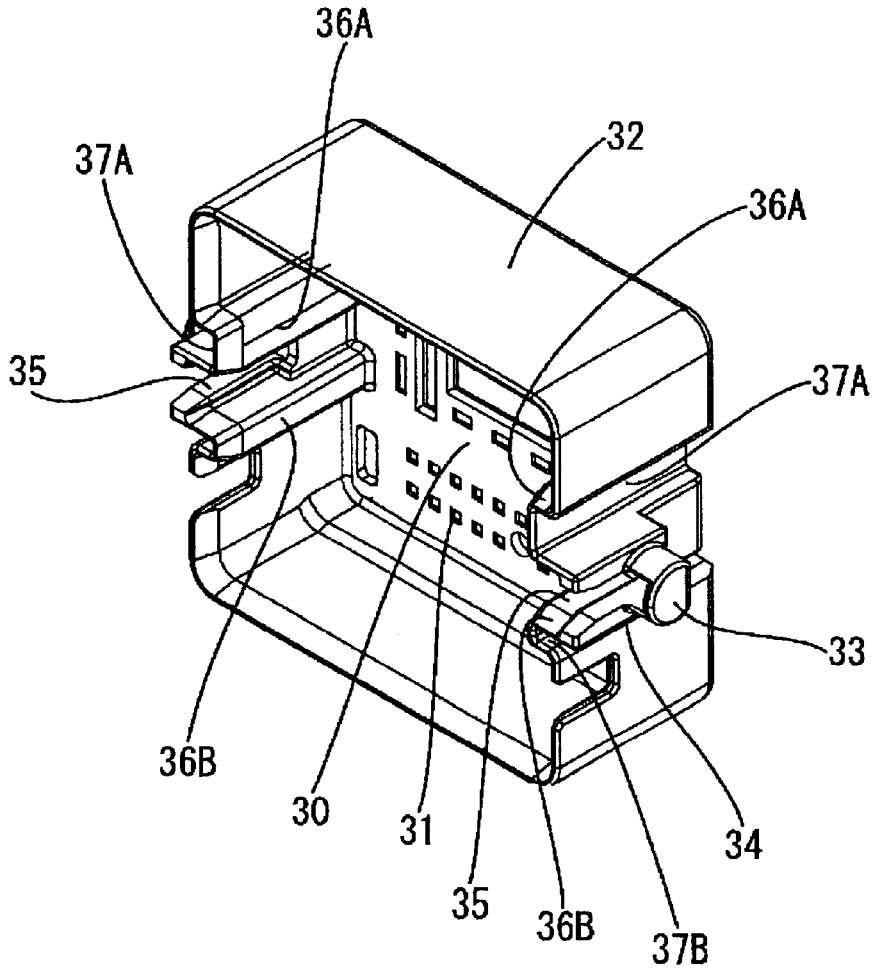
FIG. 3 is a perspective view of a moving plate.

The moving plate 30 has position holes 31 that receive and position the male tabs 12 in the receptacle 11 and a surrounding wall 32 that extends around the entire periphery of the moving plate 30, as shown in FIG. 3. The moving plate 30 is movable forward and backward parallel with the moving direction MD of the housings 10, 40 while holding the surrounding wall 32 in sliding contact with the inner surface of the receptacle 11. Two cam pins 33 project from the outer surface of the surrounding wall 32 of the moving plate 30. Each cam pin 33 has an engaging recess 34 that opens forwardly. Further, the surrounding wall 32 has left and right notches 35 that extend from the front edge of the surrounding wall 32 toward the corresponding cam pins 33, substantially in correspondence to the escape grooves 14 of the receptacle 11. Thus, the notches 35 extend substantially in the moving direction MD.

Figure 1:
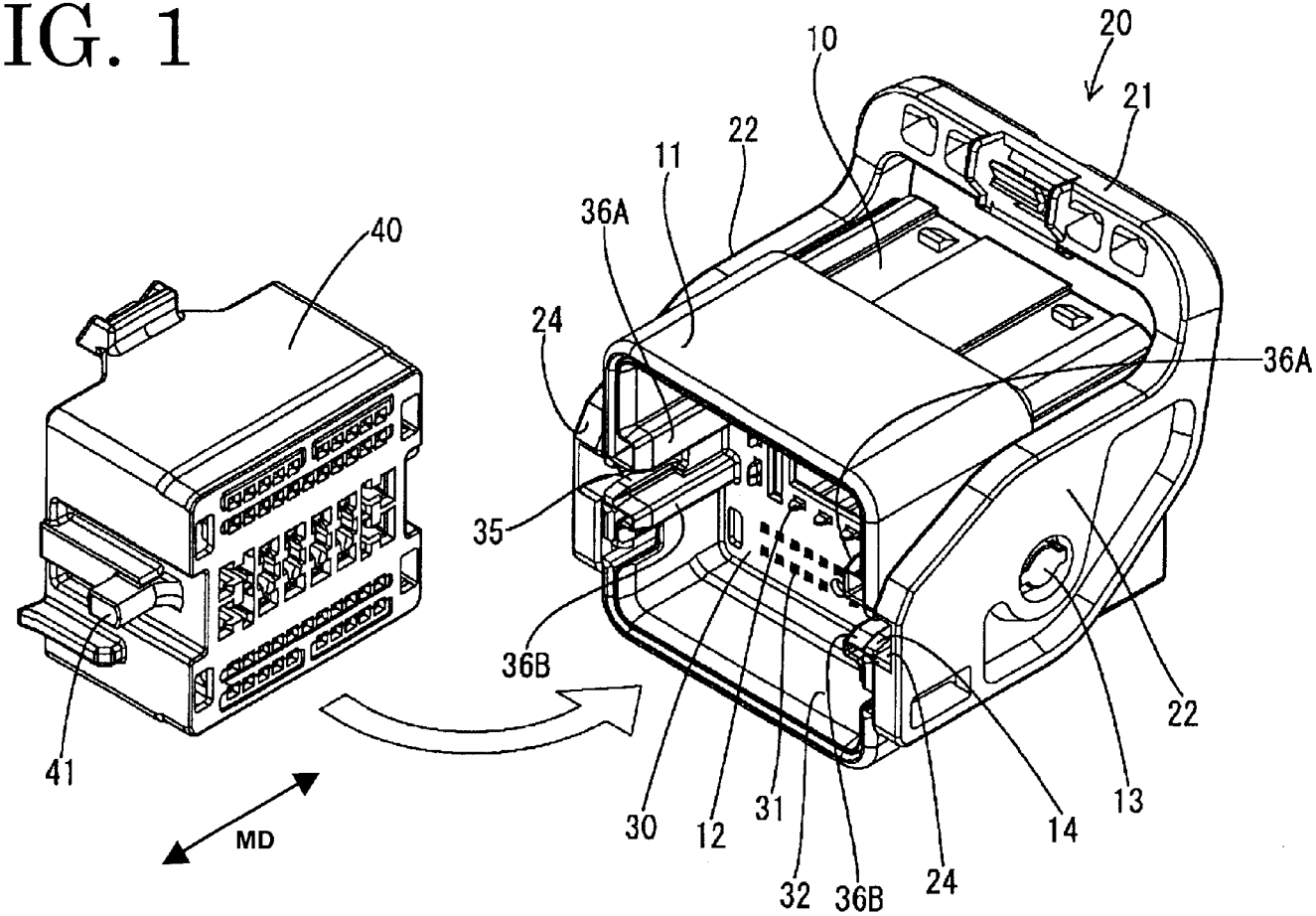
FIG. 1 is a perspective view showing of a first embodiment in a state where a male housing and a female housing are separated.

The female housing 40 is adapted to accommodate female terminal fittings (not shown) and has cam pins 41 that project from the left and right outer surfaces, as shown in FIG. 1. The front end of the female housing 40 is fittable into a space inside the surrounding wall 32 of the moving plate 30.

Figure 6:
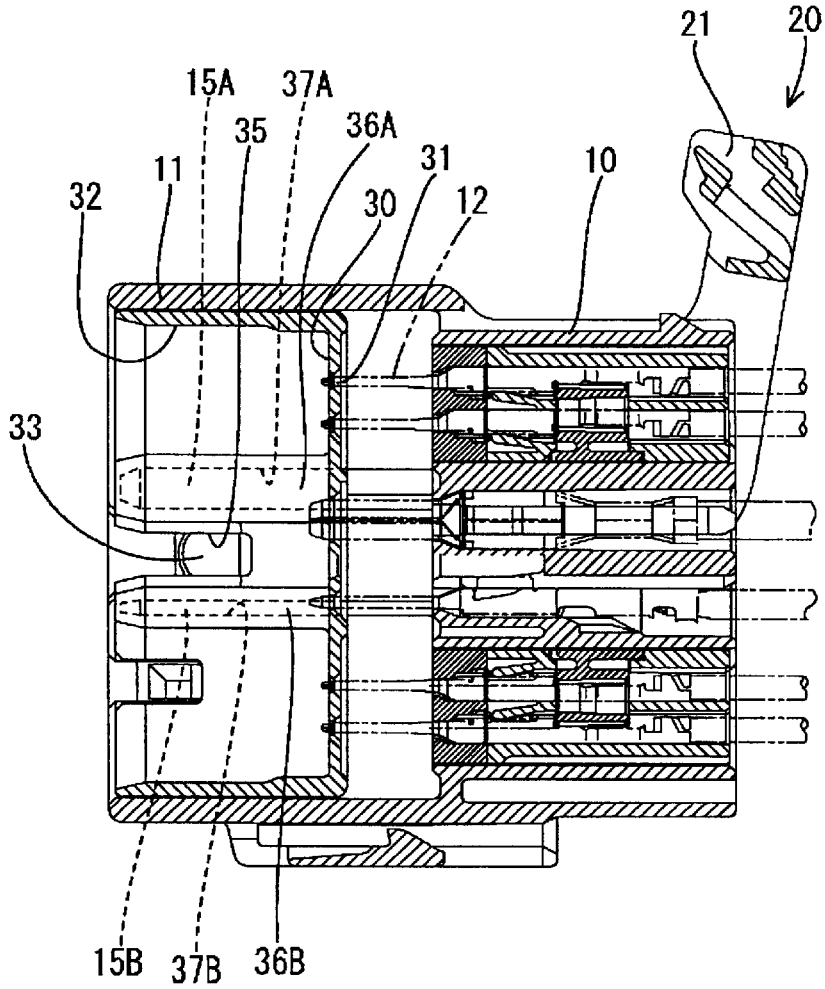
FIG. 6 is a section showing a state where the moving plate and the lever are assembled into the male housing.
Figure 7:
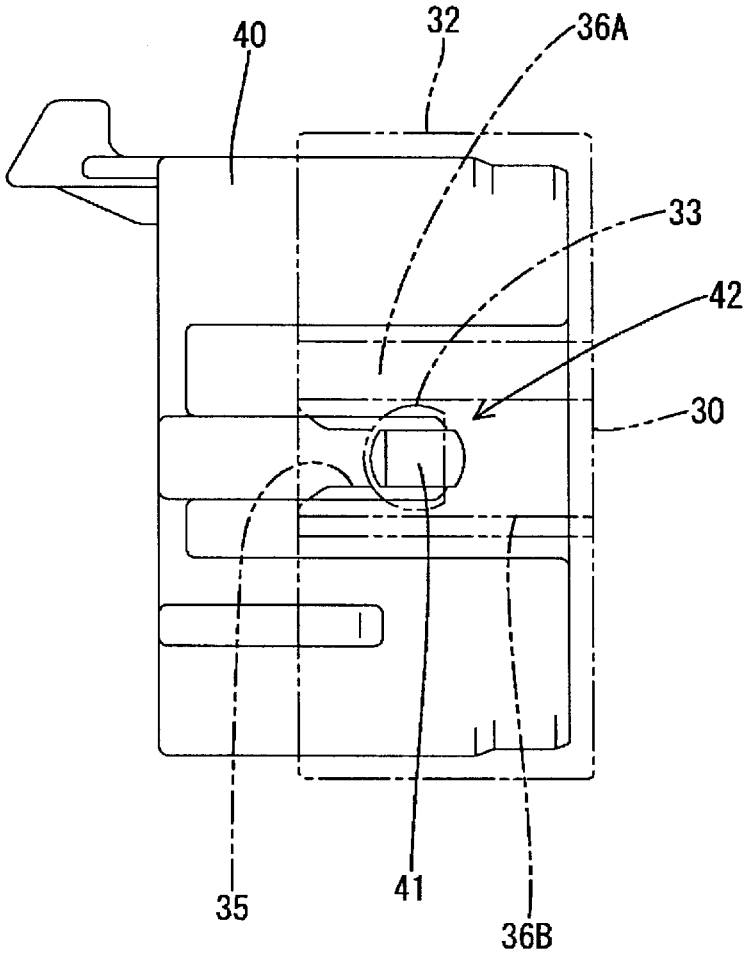
FIG. 7 is a side view showing a state where cam pins of the moving plate and the female housing are united.

The moving plate 30 is placed at a front position inside the receptacle 11 prior to connecting the housings 10, 40 to position the leading ends of the male tabs 12 (see FIGS. 1 and 6). In this state, the escape grooves 14 of the receptacle 11 align with the notches 35 of the moving plate 30. Further, the lever 20 is held at the standby position so that entrances of the cam grooves 24 open forward and align with the escape grooves 14 and the notches 35.

The female housing 40 then is fitted into the space inside the surrounding wall 32 of the moving plate 30, so that the cam pins 41 of the female housing 40 pass along the escape grooves 14 and the notches 35 and fit into the engaging recesses 34 of the cam pins 33 of the moving plate 30. As a result, the cam pins 33, 41 are united to define cam followers 42 and enter the entrances of the cam grooves 24 of the lever 20.

The lever 20 then can be pivoted and the two housings 10, 40 move smoothly into connection due to the cam action of the cam followers 42 and the cam grooves 24 even if only a small operation force is given to the lever 20. Additionally, the moving plate 30 moves in unison with the female housing 40.

As described above, the cam followers 42 are formed by uniting the cam pins 41 of the female housing 40 with the cam pins 33 of the moving plate 30 and are engaged with the cam grooves 24. The cam pins 41 of the female housing 40 pass through the notches 35 of the surrounding wall 32 of the moving plate 30. Additionally, each cam follower 42 passes through both a notch 35 of the surrounding wall 32 of the moving plate 30 and an escape groove 14 of the receptacle 11. The notches 35 and the escape grooves 14 effectively split the front half of the receptacle 11 into two. Accordingly, ribs 15A, 15B are formed on the inner surface of the receptacle 11 to ensure sufficient strength for the split receptacle 11 and the moving plate 30. The ribs 15A, 15B extend parallel with the moving direction MD of the moving plate 30 near the upper and lower edges of the respective escape grooves 14. Each rib 15A, 15B extends from a position near the front end of the receptacle 11 to the back end of the receptacle 11. The ribs 15A that extend along the upper edges of the escape grooves 14 are thicker than the ribs 15B that extend along or near the lower edges thereof. However, the upper and lower ribs 15A, 15B project the same distance from the inner surface of the receptacle 11.

The surrounding wall 32 of the moving plate 30 is formed with bent portions 36A, 36B that extend forward and backward along the moving direction MD and parallel to the longitudinal direction of the ribs 15A, 15B when the lever-type connector is in its connected state. Each bent portion 36A, 36B has a substantially U-shaped cross section which is recessed inwardly to substantially correspond to the ribs 15A, 15B. Preferably, the bent portions 36A, 36B extend along the upper and lower edges of the respective notches 35 over the entire length of the surrounding wall 32. More particularly, grooves 37A, 37B face outwardly from the surrounding wall 32 and accommodate the ribs 15A, 15B. The heights of the grooves 37A, 37B are slightly larger than the thicknesses of the corresponding ribs 15A, 15B to be fitted into the grooves 37A, 37B. Consequently, the heights of the grooves 37A extending along the upper edge of the notches 35 are slightly larger than the heights of the grooves 37B extending along the lower edges of the notches 35. The depth of the grooves 37A, 37B, i.e. a dimension between the outer surface of the surrounding wall 32 and the back end surfaces of the grooves 37A, 37B, is slightly larger than the projecting distance of the ribs 15A, 15B from the inner surface of the receptacle 11, and all the grooves 37A, 37B have the same depth.

The ribs 15A, 15B avoid a reduction in the strength of the receptacle 11 that would otherwise be caused by the formation of the escape grooves 14. Further, the bent portions 36A, 36B of the surrounding wall 32 of the moving plate 30 avoid a reduction in the strength of the surrounding wall 32 that would otherwise be due to the formation of the notches 35. This prevents the receptacle 11 and the surrounding wall 32 from being deformed to deflect and being strongly abraded against each other. As a result, a smooth connection of the two housings 10, 40 can be achieved.

The ribs 15A, 15B can be slid into the specified grooves 37A, 37B if the moving plate 30 is oriented properly. Therefore, the properly oriented moving plate 30 can be mounted into the receptacle 11. On the other hand, if the moving plate 30 is inverted, the thicker upper ribs 15A strike against the front ends of the lower bent portions 36B that correspond to the shorter grooves 37B. Thus, the moving plate 30 cannot be mounted into the receptacle 11. In this way, the ribs 15A, 15B and the bent portions 36A, 36B prevent an inverted moving plate 30 from being mounted into the receptacle 11. Therefore, the shapes of the receptacle 11 and the moving plate 30 can be simplified as compared to a case where a means for preventing improper orientation of the moving plate 30 is separate from the ribs 15A, 15B and the bent portions 36A, 36B.

In summary, a reduction in the strength of a surrounding wall of the moving plate 30 and the receptacle 11 is prevented by ribs 15A, 15B that extend along the escape grooves 14 on the inner surface of a receptacle 11 substantially parallel with a moving direction MD of the moving plate 30. Additionally, the surrounding wall 32 of the moving plate 30 is formed with inwardly recessed bent portions 36A, 36B that extend substantially along notches 35 and along the ribs 15A, 15B in a connected state of the connector. The strength of the receptacle 11 is secured by the ribs 15A, 15B that extend along or near the escape grooves 14 of the receptacle 11, and the strength of the surrounding wall 32 is secured by the bent portions 36A, 36B that extend along or near the notches 35 on the surrounding wall 32 of the moving plate 30.

Figure 8:
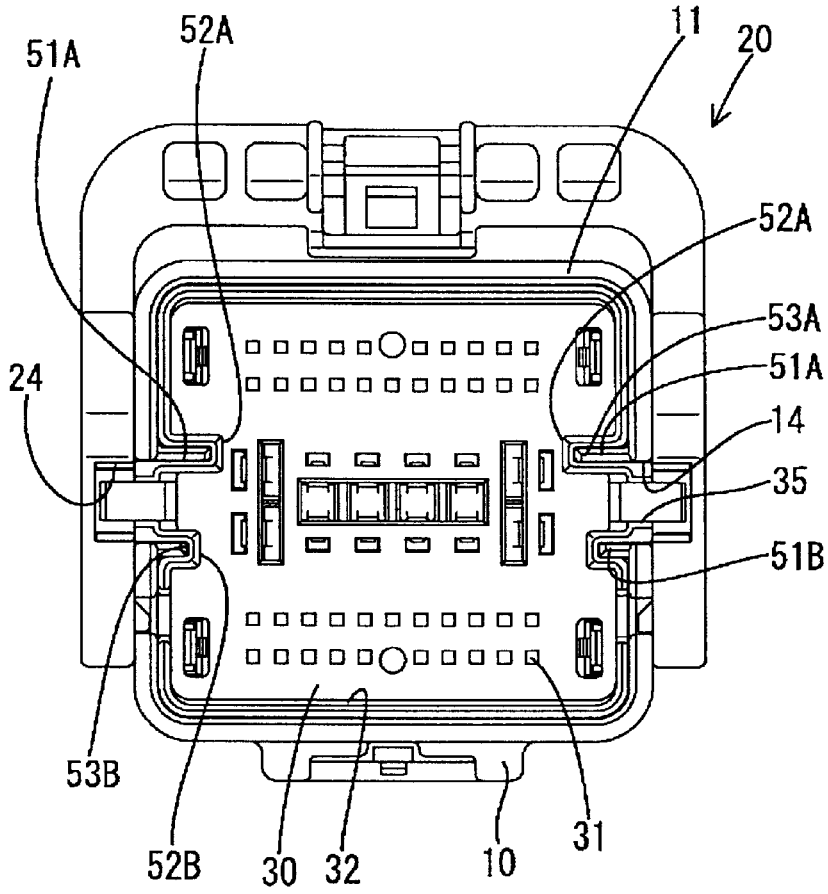
FIG. 8 is a front view of a second embodiment showing a state where a moving plate and a lever are assembled into a male housing.
Figure 9:
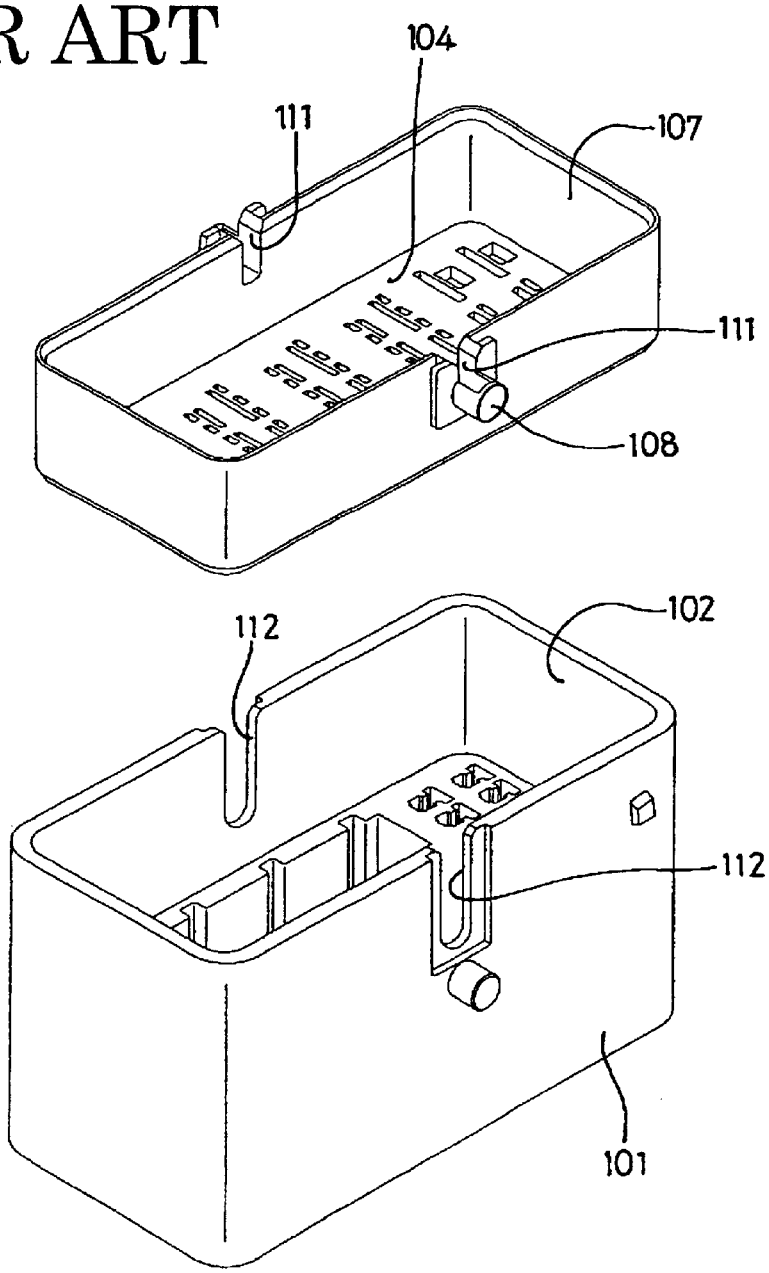
FIG. 9 PRIOR ART
FIG. 9 is a perspective view showing a state where a moving plate is detached from a male housing in a prior art connector.
Figure 10:
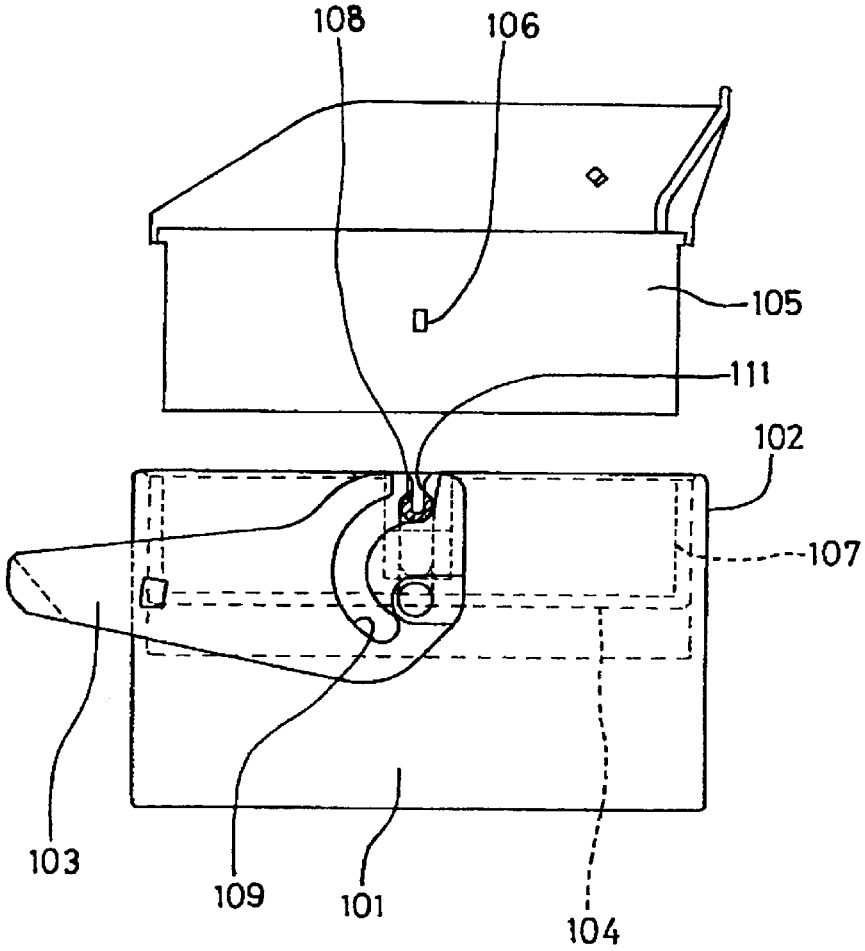
FIG. 10 PRIOR ART
FIG. 10 is a side view partly in section showing a state where a female housing is detached from the male housing in the prior art connector.
Figure 11:
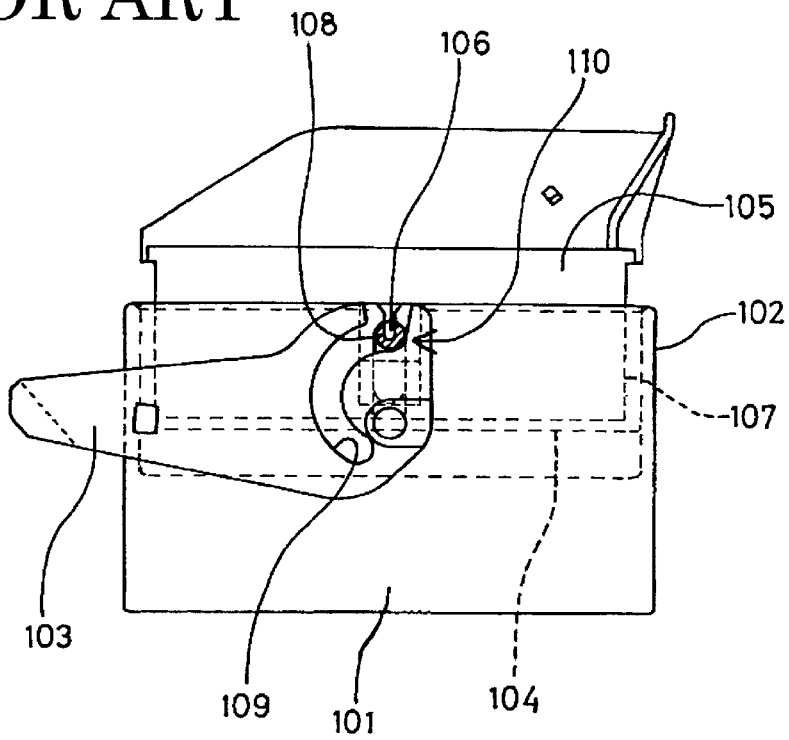
FIG. 11 PRIOR ART
FIG. 11 is a side view partly in section showing a state cam pins of the male housing and the moving plate are united in the prior art connector.

A second embodiment of the connector is illustrated in FIG. 8, and includes means for preventing an improper orientation of the moving plate 30 into the receptacle 11 that is different from the first embodiment. Since the other construction is the same as in the first embodiment, those similar elements merely are identified by the same reference numerals.

As shown in FIG. 8, the ribs 51A of the second embodiment that extend along or near the upper edges of the escape grooves 14 have a larger projecting distance than the ribs 51B extending substantially along or near the lower edges thereof. The upper and lower ribs 51A, 51B have substantially the same thickness. Further, the grooves 53A of bent portions 52A that extend along or near the upper edges of the notches 35 are deeper than the grooves 53B that extend along or near the lower edges of the notches 35. However, all the grooves 53A, 53B of this embodiment have substantially the same height.

An attempt to mount the moving plate 30 into the receptacle 11 in an inverted orientation, causes the upper ribs 51A, which have the larger projecting distance from the inner surface of the receptacle 11, to strike against the front ends of the lower bent portions 52B corresponding to the shallower grooves 53B. Thus, the moving plate 30 cannot be mounted in the receptacle 11.

The present invention is not limited to the above described and illustrated embodiments. For example, the following embodiments are also embraced by the technical scope of the present invention.

Although the ribs have an "I-shaped" cross section in the foregoing embodiments, they may have another cross section such as an "L-shaped" cross section according to the present invention.

Changing the thickness or projecting distance of the ribs and changing the thickness or depth of the recesses of the bent portions in the foregoing embodiments prevent an erroneous mounting of the moving plate. However, an erroneous mounting preventing function may be provided by other means, and the thickness and projecting distance of the ribs may be set at the same values according to the present invention.

Although only either the thickness or the projecting distance of the ribs is changed as a means for preventing an erroneous mounting of the moving plate in the foregoing embodiments, the erroneous mounting may be prevented by changing both the thickness and the projecting distance of the ribs.

What is claimed is:

1. A lever-type connector, comprising:

a first housing (10) having a receptacle (11), at least one escape groove (14) being formed in the receptacle (11);

a lever (20) pivotally supported on the first housing (10), at least one cam groove (24) being formed in the lever (20);

a moving plate (30) mounted in the receptacle (11) for movement along a moving direction (MD) and for positioning first terminal fittings (12) in the receptacle (11);

a second housing (40) fittable into the receptacle (11); and at least one cam pin means (33, 41) provided on the second housing (40) and the moving plate (30), the cam pin means (33, 41) being dimensioned to pass through the escape groove (14) of the receptacle (11) for engagement with the cam groove (24) in the lever (20);

wherein at least one rib (15A, 15B; 51A, 51B) being formed on the receptacle (11) substantially along at least part of the escape groove (14) and extending substantially parallel with the moving direction (MD) of the moving plate (30), and at least one bent portion (36A, 36B; 52A, 52B) having a cross section substantially corresponding to the rib (15A, 15B; 51A, 51B) being formed on the moving plate (30) for receiving the rib (15A, 15B; 51A, 51B).

2. The lever-type connector of claim 1, wherein the cam pin means (33, 31) comprises at least one cam pin (33) on the moving plate (30) that is unitable with at least one cam pin (41) formed on the second housing (41) to form a cam follower (42) engagable with the cam groove (24) of the lever (20).

3. The lever-type of claim 1, wherein the first housing (10) is a male housing (10), the first terminal fittings (12) are male terminal fittings (12) and the second housing (40) is a female housing (40).

4. The lever-type connector of claim 1, wherein the rib (15A, 15B; 51A, 51B) is formed on an inner surface of the receptacle (11) and the bent portion (36A, 36B; 52A, 52B) has a cross section bent to recess inwardly.

5. The lever-type connector of claim 4, wherein the bent portion (36A, 36B; 52A, 52B) is on a surrounding wall (32) of the moving plate (30).

6. The lever-type connector of claim 1, wherein the moving plate (30) has at least one notch (35) for receiving the cam pin means (41) and the bent portion (36A, 36B; 52A, 52B) is formed at least partly along the notch (35).

7. The lever-type connector of claim 6, wherein the notch (35) is formed in a surrounding wall (32) of the moving pate (30).

8. The lever-type connector of claim 1, wherein:

a plurality of ribs (15A, 15B; 51A, 51B) are formed, at least one of the ribs (15A; 51A) having a cross section different from cross sections of the other of the ribs (15B; 51B);

a plurality of bent portions (36A, 36B; 52A, 52B) are formed, the bent portions (36A, 36B; 52A, 52B) defining grooves (37A, 37B; 53A, 53B) for receiving the ribs (15A, 15B; 51A, 51B) therein, and at least one of the grooves (37A; 53A) having a cross section different from cross sections of the other grooves (37B; 53B), the cross section of the at least one groove (37A; 53A) substantially corresponding to the cross section of the at least one rib (15A; 51A) for at least partly receiving the at least one rib (15A; 51A) therein, and the cross sections of the other of the grooves (37B; 53B) differing from the cross section of the at least one rib (15A; 51A) to prevent receiving the at least one rib (15A, 51A) therein.

9. The lever-type connector of claim 8, wherein:

at least one of the thickness of the ribs (15A, 15B; 51A, 51B) and the projecting distance thereof from the inner surface of the receptacle (11) is set to differ among the plurality of ribs (15A, 15B; 51A, 51B), and the width and depth of the grooves (37A, 37B; 53A, 53B) are set individually for the respective grooves (37A, 37B; 53A, 53B) to substantially correspond to the thickness and projecting distance of the ribs (15A, 15B; 51A, 51B) to be accommodated in the grooves (37A, 37B; 53A, 53B).

* * * * *